US006223371B1

(12) United States Patent
Antinori et al.

(10) Patent No.: US 6,223,371 B1
(45) Date of Patent: May 1, 2001

(54) MATTRESS AND METHOD OF MANUFACTURE

(75) Inventors: Steven J. Antinori, 4908 St. Croix Dr., Tampa, FL (US) 33629; Rick Robinson, Tampa, FL (US)

(73) Assignee: Steven J. Antinori, Tampa, FL (US)

( * ) Notice: Subject to any disclaimer, the term of this patent is extended or adjusted under 35 U.S.C. 154(b) by 0 days.

(21) Appl. No.: 09/292,604

(22) Filed: Apr. 15, 1999

(51) Int. Cl.[7] ..... A47C 27/15
(52) U.S. Cl. ..... 5/727; 5/655.9; 5/740
(58) Field of Search ..... 5/690, 727, 728, 5/729, 731, 336, 740, 655.9

(56) References Cited

U.S. PATENT DOCUMENTS

| | | | | |
|---|---|---|---|---|
| Re. 32,734 | | 8/1988 | McLeod . | |
| 2,432,352 | | 12/1947 | Strotz . | |
| 2,721,339 | | 10/1955 | Johnson . | |
| 3,026,544 | * | 3/1962 | Persicke et al. | 5/740 X |
| 3,047,888 | | 8/1962 | Shecter et al. . | |
| 3,051,601 | | 8/1962 | Schick . | |
| 3,110,042 | | 11/1963 | Slemmons . | |
| 3,287,748 | | 11/1966 | Trogdon et al. . | |
| 3,394,414 | | 7/1968 | Unger . | |
| 3,534,417 | | 10/1970 | Boyles . | |
| 3,846,857 | | 11/1974 | Weinstock . | |
| 3,939,508 | * | 2/1976 | Hall et al. | 5/727 |
| 4,673,452 | | 6/1987 | Awdhan . | |
| 4,768,251 | | 9/1988 | Baskent . | |
| 5,022,111 | | 6/1991 | Fenner, Sr. . | |
| 5,031,261 | | 7/1991 | Fenner, Sr. . | |
| 5,107,558 | | 4/1992 | Luck . | |
| 5,138,730 | * | 8/1992 | Masuda | 5/736 X |
| 5,430,901 | | 7/1995 | Farley . | |
| 5,474,362 | * | 12/1995 | Albecker | 297/452.32 |
| 5,604,021 | * | 2/1997 | Wagner | 428/218 |
| 5,745,940 | | 5/1998 | Roberts et al. . | |

* cited by examiner

*Primary Examiner*—Terry Lee Melius
*Assistant Examiner*—Fredrick Conley
(74) *Attorney, Agent, or Firm*—Diller, Ramik & Wight

(57) ABSTRACT

A method of manufacturing mattresses is achieved by providing first and second layers of latex material having different indentation load deflection values. Each layer is then cut lengthwise along a longitudinal plane, preferably a medial plane to define first and second layer portions of the first and second layers each of an identical height. The layer portions are then cross united and adhesively bonded together thereby producing a mattress possessing a composite load deflection value dictated by the different indentation load deflection values of the starting layers. Preferably matching recesses are formed in the first and second layer portions of both layers. Medial recesses receive postural inserts of relatively high ILD values, whereas transverse recesses at headed foot sections are aligned to define voids at the foot and head sections of the mattress to provide head and foot relief.

31 Claims, 2 Drawing Sheets

MATTRESS AND METHOD OF MANUFACTURE

FIELD OF THE INVENTION

This invention is directed to a novel mattress and the method of manufacture thereof.

BACKGROUND OF THE INVENTION

Laminated foam mattresses which are designed to relieve or reduce the pressure exerted on the body of a person lying on the mattress are relatively conventional. As an example of the latter, U.S. Pat. No. 5,022,111 issued to William G. Fenner, Sr. on Jun. 11, 1991 discloses a triple layer laminated mattress having a middle layer formed of a first type of polyurethane foam and an upper and lower layer formed of a second type of polyurethane foam. The three layers forming the laminated mattress are said to work in conjunction to provide enhanced comfort and a reduction or relief in pressure on the user. The upper and lower layers also differ in density from the middle layer and include Indentation Load Deflection (ILD) values which are lower than the Indentation Load Deflection values of the middle layer.

Another typical multi-ply mattress is disclosed in Re. 32, 734 issued to Arlis D. McLeod on Aug. 23, 1988. The mattress thereof includes a firm mattress section separated from a soft mattress section by a stiffener board laminated therebetween.

Another mattress possessing particular utility in hospitals and nursing homes to reduce the incidents and severity of bed sores while improving muscle tone and reducing back ache is disclosed in U.S. Pat. No. 3,846,857 granted on Nov. 12, 1974 in the name of Clifford Weinstock. The mattress features a plurality of sections of foam whose densities and degrees of compressibility vary, so that regulated pressures will be applied to different sections of the body for maximum comfort. The mattress may be turned to change the pressure points of the body periodically, as need arises. An upper layer of the mattress is formed of several separate sections or slabs. A so-called head slab is recessed and accommodates therein an upper slab with these two slabs varying in density.

U.S. Pat. No. 5,745,940 issued on May 5, 1998 to Derek Roberts et al. discloses a mattress which is made from four so-called comfort modules having different indentation force deflection (IFD) values which are secured to each other. Such modules are interchangeable and can be stacked in a comfort module chamber to essentially construct a mattress to accommodate the specific weight of a person.

U.S. Pat. No. 5,430,901 issued on Jul. 11, 1995 to David L. Farley discloses in FIG. 12 nine different pieces of material assembled together to form a single mattress to set-off regions of comparatively differing firmness/softness.

Another mattress constructed essentially as a polyurethane foam base with a polygonal recess into which is inserted an insert is disclosed in U.S. Pat. No. 5,107,558 issued on Apr. 28, 1992 to Werner Lück. The insert may vary in its construction and three specific examples are given, including in each case an envelope filled with (a) fragments of polyurethane foam, (b) two layers of polyurethane foam and (c) a mixture of polyurethane rods and beads. All of this is provided to assure differing degrees of firmness/softness.

In U.S. Pat. No. 5,031,261 granted on Jul. 16, 1991 to William G. Fenner, Sr., a laminated foam mattress is disclosed which is formed of two layers bonded to each other. A base layer is constructed from polyurethane foam material of a specific density differing from an upper layer, likewise being formed from polyurethane foam. The two layers differ in Indentation Load Deflection values.

In U.S. Pat. No. 4,673,452 granted on Jun. 16, 1987 to Deo P. Awdhan, several different mattresses are disclosed including a two-ply mattress, a three-ply mattress and a three-ply mattress bounded by a peripheral frame with at least one of the plies or layers being convoluted.

In U.S. Pat. No. 4,768,251 granted on Sep. 6, 1988 to Feyyaz O. Baskent, a mattress pad is disclosed which includes a center section into which is inserted a pair of superimposed laminates or plies constituting a torso support insert member made of polyurethane material.

The latter prior art patents include many disadvantages, including all of those referenced in U.S. Pat. No. 5,022,111, namely, insufficient pressure reduction, poor body-to-mattress conformance, discomfort due to rigid foam or discomfort due to bottoming out of soft foam or foam inserts, etc. Moreover, manufacturing costs for such prior art mattresses are relatively exorbitant, again as is referenced in U.S. Pat. No. 5,022,111.

SUMMARY OF THE INVENTION

The present invention provides a novel multi-ply mattress which achieves all advantages of known mattresses and provides the same at relatively low cost. In the simplest form of the invention, two layers of mattress materials, preferably foam latex, are provided which differ from each other in their Indentation Load Deflection (ILD) values. For example, the ILD of one layer might be 24, whereas the ILD of a second layer might be 38. Obviously, the first layer is softer than the more firm second layer. Each layer is then cut or sliced longitudinally, preferably along its midline, to form first and second layer portions of the first layer and first and second layer portions of the second layer. The layer portions are also provided with selective mating recesses preferably at opposite ends and at a mid portion of each of the layer portions. An insert or inserts are placed in one or more of the recesses located at the central or medial portions of the layer portions, and a layer portion of 24 ILD value is unitized to a layer portion of 38 ILD value with, of course, the recesses (and insert or inserts) in opposing relationship to each other. Thus, in this fashion, two layers or plies of mattress material of differing ILD values can be manufactured into two mattresses, each of which includes a composite of the two ILD values to achieve the benefits afforded thereby, particularly as supplemented by the inserts located at the medial portions of the laminated mattresses and the voids or recesses located at the opposite ends (head and foot sections thereof).

With the above and other objects in view that will hereinafter appear, the nature of the invention will be more clearly understood by reference to the following detailed description, the appended claims and the several views illustrated in the accompanying drawings.

DESCRIPTION OF THE PREFERRED EMBODIMENTS

A novel mattress constructed in accordance with this invention is fabricated from several layers, cores, laminates or layer portions differing in Indentation Load Deflection (ILD) values, but each "starter" core or layer is constructed from latex rubber, preferably manufactured from 100 percent organic Talalay latex which creates ultimate latex foam. Talalay latex rubber is a milky white liquid consisting of minute rubber particles dispersed in water which is whipped into a foam, electronically weighed and automatically dispensed into a mold by a mechanical robot. After the mold is hydraulically closed, an electric timer controls the various steps to convert the foam to its final, permanently vulcanized shape. The foam is heated to over 200° and frozen to 21° below zero. Once the vulcanization process is completed, the wet foam core is stripped out of the mold, washed with hundreds of gallons of water per core, and high pressure rollers squeeze each core to flush away any residual soap and brings the core to a semi-dry state. The washed cores then enter a steam-heated, pressure-circulated, hot-air oven for drying followed by fresh-air cooling. The latex cores are then individually classified for the degree of firmness. This is preferably done by an in-line computer which reads data measured by electronic load cells and then rates the compression level of each core to assure consistency of firmness. Examples from each production run then undergo a series of testing for flexibility and durability. For example, to measure the equivalent of ten years of use, an impact tester subjects each sample from a core to more than 15,000 impacts during a twenty-four hour period.

Figure 1:
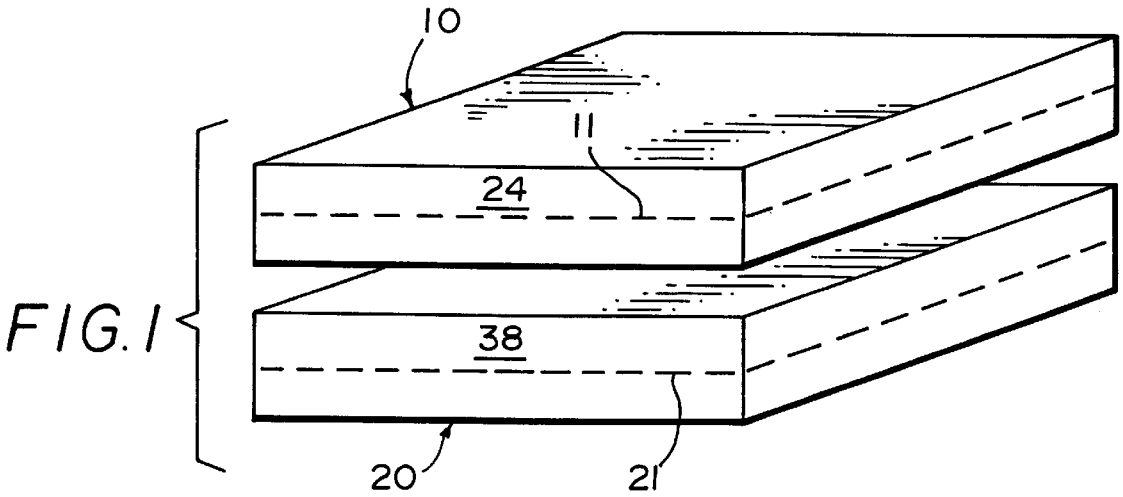
FIG. 1 is a fragmentary perspective view of two layers of mattress materials of different Indentation Load Deflection (ILD) values, the upper layer possessing 24 ILD value and the lower layer possessing 38 ILD value.

In FIG. 1 of the drawings, two such "starting" or "stock" layers or cores of latex mattress material are illustrated and are generally designated by the reference numerals 10 and 20. The two layers 10 and 20 are identical in length, width and thickness and differ only in Indentation Load Deflection (ILD) values. The layer 10 has an ILD value of 24, whereas the layer 20 has an ILD value of 38. These values are exemplary only and can be varied in accordance with the present invention, but in this example, the layer 10 is, obviously, softer than the more firmer layer 20.

Figure 2:
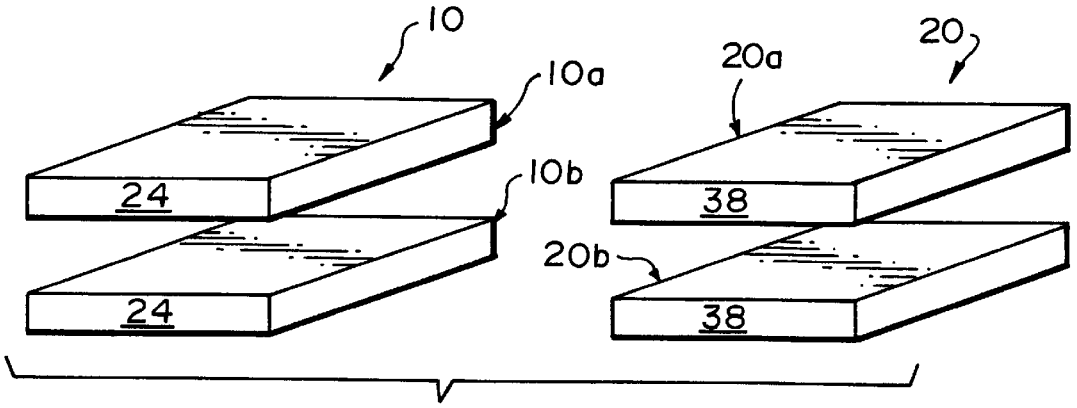
FIG. 2 is a perspective view of the two layers of FIG. 1 reduced in size, and illustrates the two layers sliced longitudinally along mid lines thereof to define two layer portions of 24 ILD value and two layer portions of 38 ILD value.

Reference numerals 11 and 21 define bisecting planes of the respective layers 10, 20 along which the layers are cut or sliced by conventional saws to separate the layer 10 into layer portions 10*a*, 10*b* (FIG. 2) and the layer 20 into layer portions 20*a*, 20*b*. The peripheral dimensions of the layer portions 10*a*, 10*b*, 20*a* and 20*b* are identical and correspond to those of the layers 10, 20, respectively, and the only change is that the thickness of the layer portions 10*a*, 10*b* and 20*a*, 20*b* have been halved relative to the respective layers 10, 20.

The layer portions 10*a*, 10*b*, 20*a* and 20*b* are thereafter provided with identically located cross-matching transverse grooves, channels or recesses by conventional cutting tools, such as saws. The layer portion 10*a* is provided with a centrally located transverse rectangularly outwardly opening groove, channel or recess 11*a* and on opposite sides thereof is a transverse triangular outwardly opening groove, channel or recess 12*a*, 13*a*. Identical transverse channels, slots or recesses 14*a*, 15*a*, 16*a*; 21*a*, 22*a*, 23*a* and 24*a*, 25*a*, 26*a* are formed in the respective layer portions 10*b*, 20*a* and 20*b*.

Figure 3:
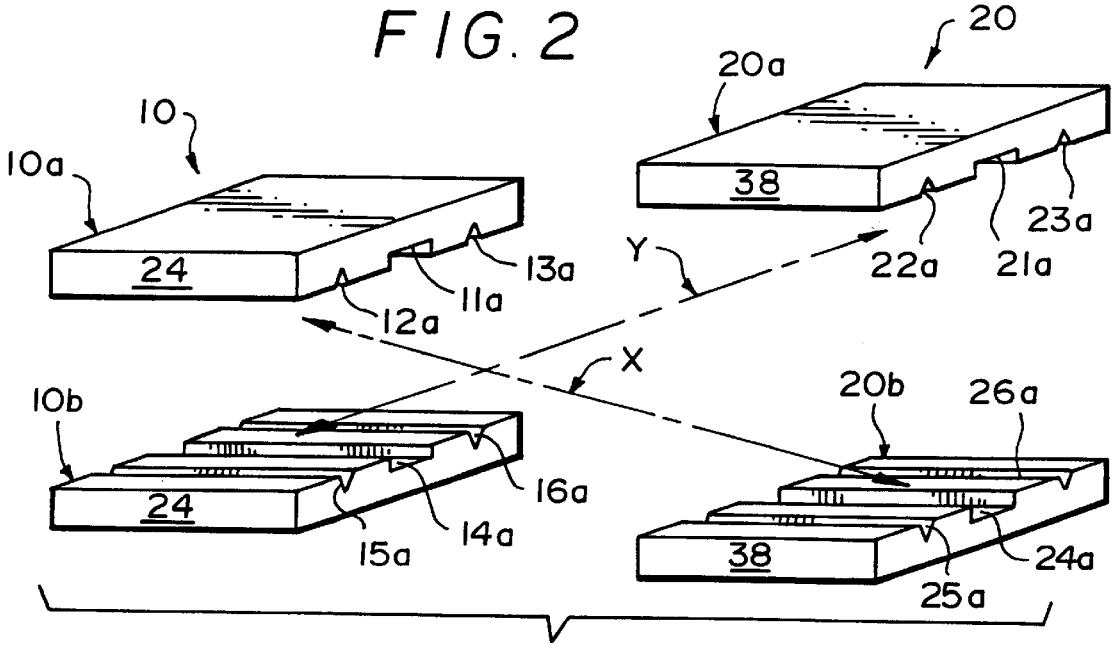
FIG. 3 is a perspective view similar to FIG. 1, and illustrates each of the layer portions identically provided with transverse recesses in opposite longitudinal ends thereof and a medial portion therebetween with all of the recesses being symmetrical to the four layer portions, and opposite headed arrows indicating the manner in which the two 24 ILD value layers are cross assembled in recess-to-recess opposing relationship to the 38 ILD value layer portions.
Figure 4:
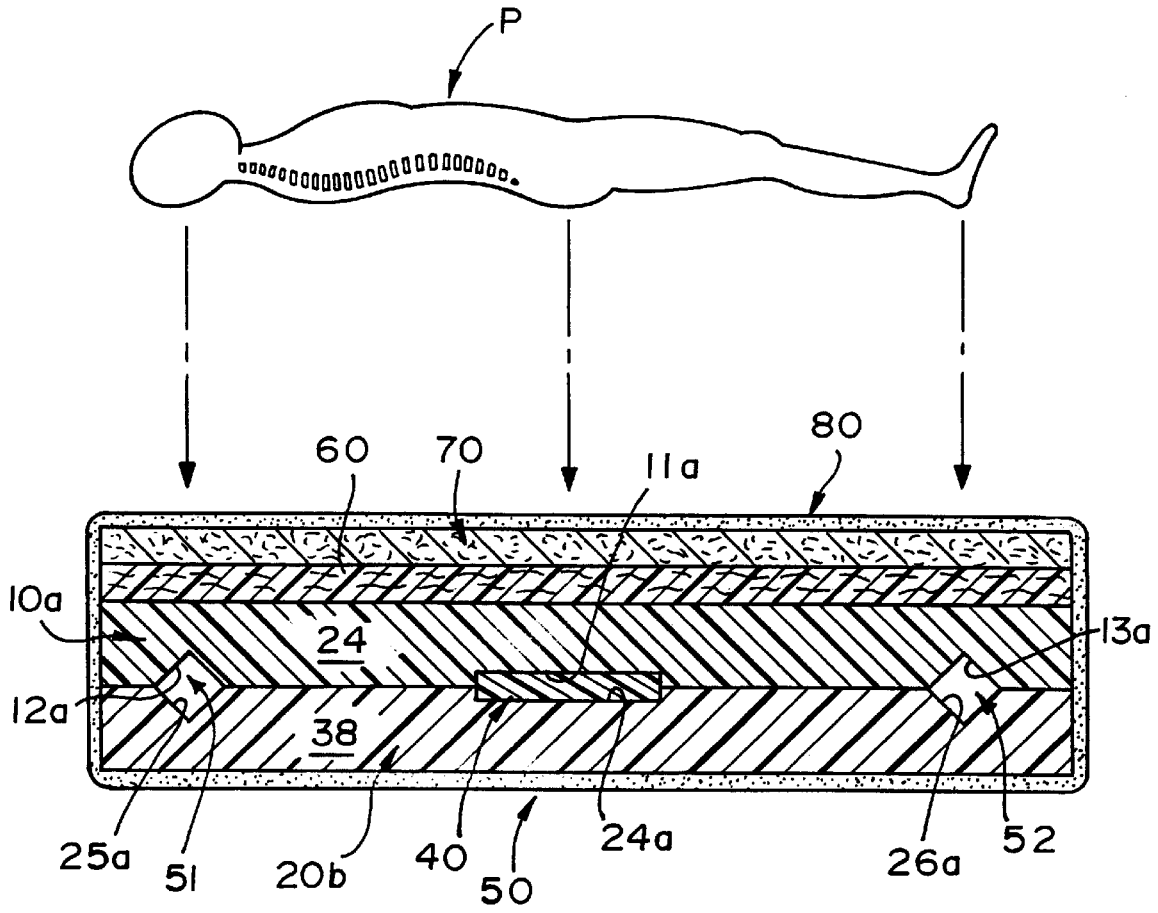
FIG. 4 is an enlarged cross-sectional view through a multi-ply mattress which further includes one or more inserts placed in the central or medial recesses prior to sandwiching and adhesively bonding the 24 ILD value layer portion to the 38 ILD value layer portion, a thinner convoluted 24 ILD value layer adhesively bonded to the first-mentioned 24 ILD value layer, and a silk fiber blend overlying the convoluted layer with all layers being encapsulated in an outer layer of cloth.

Double headed broken arrows X, Y in FIG. 3 diagrammatically depict the manner in which the layer portions 10*a*, 20*b* are cross assembled to each other, as are the layer portions 10*b*, 20*a*. However, prior to such cross assembly, an insert 40 (FIG. 4), preferably latex having a relatively high Indentation Load Deflection (ILD) value, such as ILD 60, is inserted in one of the central recesses 11*a*, 24*a* and one of the central recesses 14*a*, 21*a*. The insert 40 is inserted in the recess 24*a* of the layer portion 20*b* after the application of adhesive to either or both of the opposing surfaces (unnumbered) of the layer portions 10*a*, 20*b* which are thereafter brought into overlying aligned bonding relationship to each other, in the manner best illustrated in FIG. 4. The firmer insert 40 affords desired firmness in the postural region of a person P (FIG. 4) lying upon the completed mattress which is generally designated by the reference numeral 50. However, the recesses 12*a*, 25*a*, and 13*a*, 26*a* are devoid of inserts and define respective transverse channels 51, 52 at head end (unnumbered) and foot end (also unnumbered) sections of the mattress 50 which desirably reduce the softness of the overall mattress 50 at these two regions.

A third layer 60 (FIG. 4) of convoluted zoned 24 ILD value compression latex is adhesively bonded to the uppermost surface (unnumbered) of the latex layer portion 10*a*. A silk fiber blend layer 70 is applied atop the convoluted layer 60 and all layers 10*a*, 20*b*, 60 and 70 are encapsulated in a durable cloth cover 80 conventionally sewn in place in a conventional fashion.

The multi-ply mattress 50 thereby affords excellent postural support in the area of the insert 40 while achieving pressure relief at the head and foot sections because of the channels 51, 52. Thus, the firmer layer portion 20*b* provides structural support and stability which is a prerequisite for retaining mattress integrity over years of use when supported by conventional bed frame, while optimum less firm/softer body support is provided by the layer portion 10*a* and the convoluted layer 60. Most notably, however, is the fact that "stock" layers or cores 10, 20 of standard mattress thickness (5½") can be utilized in conjunction with the process just described to manufacture laminated or multi-layered mattresses of differing ILD values, while maintaining identical core height (5½") by simply slicing the initial starting layers or cores 10, 20 along the bisecting cut lines 11, 21 (FIG. 1). This achieves a marked reduction in "starting" latex core inventory which reduces warehouse capacity and attendant costs associated therewith. Furthermore, by cutting starting cores of layers 10, 20 along the respective medial lines 11, 21, and cross uniting the layer portions in the manner described relative to FIG. 3 and the double headed arrows X, Y, two identical mattresses of composite Indentation Load Deflection (ILD) values can be manufactured in a relatively straightforward and inexpensive manner. Furthermore, through the utilization of one or more transverse recesses, such as the recesses 11*a*, 24*a* and 14*a*, 21*a*, postural support can be firmed in a selective fashion through the insert 40, while the channels or voids 51, 52 provide necessary pressure relief at the head and foot sections, respectively, of the mattress 50. In this fashion, ultimate comfort and long life is achieved at minimum costs.

Although a preferred embodiment of the invention has been specifically illustrated and described herein, it is to be understood that minor variations may be made in the apparatus without departing from the spirit and scope of the invention, as defined the appended claims.

What is claimed is:

1. A method of manufacturing mattresses or the like comprising the steps of providing first and second layers of material of different indentation load deflection values, separating each of the layers lengthwise along a longitudinal plane to define first and second layer portions of the first layer and first and second layer portions of the second layer, and unitizing the first layer portions of the first and second layers with the second layer portions of the respective second and first layers thereby manufacturing mattresses possessing a composite load deflection value dictated by the different indentation load deflection values of the first and second layers.

2. The method as defined in claim 1 wherein the first and second layers are made of latex foam.

3. The method as defined in claim 1 wherein the first and second layer portions are each substantially one-half the thickness of their respective first and second layer.

4. The method as defined in claim 1 including the steps of forming a recess in at least the first layer portion of the first layer, inserting an insert in the recess, and sandwiching the insert between the first layer portion of the first layer and the second layer portion of the second layer.

5. The method as defined in claim 1 including the steps of forming a recess in at least the first layer portion of the first layer prior to the performance of the unitizing step, thereafter inserting an insert in the recess, and preceding the performance of the unitizing step sandwiching the insert between the first layer portion of the first layer and the second layer portion of the second layer.

6. The method as defined in claim 1 including the step of forming a recess in at least the first layer portion of the first layer prior to the performance of the unitizing step, and preceding the performance of the unitizing step closing the recess by overlying the same with the second layer portion of the second layer.

7. The method as defined in claim 1 including the steps of forming at least one recess in opposite ends of at least the first layer portion of the first layer prior to the performance of the unitizing step, and preceding the performance of the unitizing step closing the recess by overlying the same with the second layer portion of the second layer.

8. The method as defined in claim 1 including the steps of forming at least one recess in opposite ends and between the opposite ends of at least the first layer portion of the first layer prior to the performance of the unitizing step, and preceding the performance of the unitizing step closing the recesses by overlying the same with the second layer portion of the second layer.

9. The method as defined in claim 1 including the steps of forming at least one recess in opposite ends and between the opposite ends of at least the first layer portion of the first layer prior to the performance of the unitizing step, inserting an insert in the one recess between the opposite ends, and preceding the performance of the unitizing step closing the recesses by overlying the same with the second layer portion of the second layer.

10. The method as defined in claim 1 including the steps of forming a recess in the first and second layer portions of the first and second layers prior to the performance of the unitizing step, and preceding the performance of the unitizing step closing the recesses by (a) positioning the recesses of the first layer portion of the first layer in opposing relationship to the recesses of the second layer portion of the second layer and (b) positioning the recesses of the first layer portion of the second layer in opposing relationship to the recesses of the second layer portion of the first layer.

11. The method as defined in claim 1 including the steps of forming a recess in the first and second layer portions of the first and second layers prior to the performance of the unitizing step, inserting an insert into at least one of the recesses and preceding the performance of the unitizing step closing the recesses by (a) positioning the recesses of the first layer portion of the first layer in opposing relationship to the recesses of the second layer portion of the second layer and (b) positioning the recesses of the first layer portion of the second layer in opposing relationship to the recesses of the second layer portion of the first layer.

12. The method as defined in claim 1 including the step of providing a third convoluted zoned layer of material having an indentation load deflection value corresponding substantially to the indentation load deflection value of one of the first and second layers, and unitizing the third layer to one of the first and second layer portions.

13. The method as defined in claim 1 including the step of providing a third convoluted zoned layer of material having an indentation load deflection value corresponding substantially to the indentation load deflection value of the layer possessing the lower indentation load deflection value, and unitizing the third layer to one of the layer portions of the layer possessing the lower indentation load deflection value.

14. The method as defined in claim 1 including the step of providing a third convoluted zoned layer of material having an indentation load deflection value corresponding substantially to the indentation load deflection value of the layer possessing the lower indentation load deflection value, unitizing the third layer to one of the layer portions of the layer possessing the lower indentation load deflection value, and unitizing a fiber layer to the third layer.

15. A method of manufacturing mattresses or the like comprising the steps of providing first and second layers of material of different indentation load deflection values, separating each of the layers lengthwise along a longitudinal plane to define first and second layer portions of the first layer and first and second layer portions of the second layer, forming at least one recess in opposite ends and at least another recess between the opposite ends of the first and second layer portions of the first and second layers placing an insert in at least one of the another recesses, aligning the one and another recesses of the first layer portion of the first layer with the respective one and another recesses of the second layer portion of the second layer, aligning the one and another recesses of the second layer portion of the first layer with the respective one and another recess of the first layer portion of the second layer, and unitizing the so aligned layer portions to each other.

16. The method as defined in claim 15 including the step of placing an insert in an other of the another recesses prior to the performance of the aligning steps.

17. The method as defined in claim 16 including the step of providing a third convoluted zoned layer of material having an indentation load deflection value corresponding substantially to the indentation load deflection value of the layer possessing the lower indentation load deflection value, and unitizing the third layer to one of the layer portions of the layer possessing the lower indentation load deflection value.

18. The method as defined in claim 16 including the step of providing a third convoluted zoned layer of material having an indentation load deflection value corresponding substantially to the indentation load deflection value of the layer possessing the lower indentation load deflection value, unitizing the third layer to one of the layer portions of the layer possessing the lower indentation load deflection value, and unitizing a fiber layer to the third layer.

19. The method as defined in claim 15 including the step of providing a third convoluted zoned layer of material having an indentation load deflection value corresponding substantially to the indentation load deflection value of the layer possessing the lower indentation load deflection value, and unitizing the third layer to one of the layer portions of the layer possessing the lower indentation load deflection value.

20. The method as defined in claim 15 including the step of providing a third convoluted zoned layer of material having an indentation load deflection value corresponding substantially to the indentation load deflection value of the layer possessing the lower indentation load deflection value, unitizing the third layer to one of the layer portions of the layer possessing the lower indentation load deflection value, and unitizing a fiber layer to the third layer.

21. A mattress comprising a lower layer portion of latex material having a surface bonded directly to an opposing surface of an upper layer portion of latex material along sliced opposing surfaces of the layer portions, the lower layer portion having a relatively high Indentation Load Deflection value, the upper layer portion having a relatively low Indentation Load Deflection value as compared to that of the upper layer portion, opposing recesses at least in one of said surfaces of said upper and lower layer portions, and a latex insert housed in said opposing recesses having an Indentation Load Deflection value substantially higher than that of said lower layer portion.

22. The mattress as defined in claim 21 including a convoluted compression latex layer bonded to said upper layer portion and having an Indentation Load Deflection value substantially equal thereto.

23. The mattress as defined in claim 21 including a convoluted compression latex layer bonded to said upper layer portion and having an Indentation Load Deflection value substantially equal thereto, a fiber layer overlying said convoluted compression latex layer, and cloth encompassing all said layer and layer portions.

24. A mattress comprising a lower layer portion of latex material having a surface bonded directly to an opposing surface of an upper layer portion of latex material along sliced opposing surfaces of the layer portions, the lower layer portion having a relatively high Indentation Load Deflection value, the upper layer portion having a relatively low Indentation Load Deflection value as compared to that of the upper layer portion, and opposing open recesses at opposite foot and head ends of said upper and lower layer portions defining softer foot and head relief mattress portions.

25. The mattress as defined in claim 24 including a convoluted compression latex layer bonded to said upper layer portion and having an Indentation Load Deflection value substantially equal thereto.

26. The mattress as defined in claim 24 including a convoluted compression latex layer bonded to said upper layer portion and having an Indentation Load Deflection value substantially equal thereto, a fiber layer overlying said convoluted compression latex layer, and cloth encompassing all said layer and layer portions.

27. A pair of mattresses comprising first and second mattresses, each of said first and second mattresses including first and second layers of material of different Indentation Load Deflection values, each first and second layer having a respective first and second sliced surface, said first sliced surface of said first layer of said first mattress being a substantial mirror image of said first sliced surface of said first layer of said second mattress, said second sliced surface of said second layer of said first mattress being a substantial mirror image of said second sliced surface of said second layer of said second mattress, and means for unitizing said first and second layers together whereby each of said mattresses possesses a substantially identical composite deflection value dictated by the different indentation load deflection values of the first and second layers of the material.

28. The pair of mattresses as defined in claim 27 including at least one recess between the first and second layers of each of said first and second mattresses.

29. The pair of mattresses as defined in claim 28 including an insert within at least one of said recesses.

30. The pair of mattresses as defined in claim 28 wherein said unitizing means is defined by a bond between said first and second layers of said first and second mattresses.

31. The pair of mattresses as defined in claim 27 wherein said unitizing means is defined by a bond between said first and second layers of said first and second mattresses.

* * * * *